US007161574B2

(12) United States Patent
Kimura et al.

(10) Patent No.: US 7,161,574 B2
(45) Date of Patent: Jan. 9, 2007

(54) LIQUID CRYSTAL DISPLAY ELEMENT DRIVING METHOD AND LIQUID CRYSTAL DISPLAY USING THE SAME

(75) Inventors: Masanori Kimura, Daito (JP); Ichiro Sato, Yokohama (JP); Katsuhiko Kumagawa, Neyagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 262 days.

(21) Appl. No.: 10/479,152

(22) PCT Filed: May 30, 2002

(86) PCT No.: PCT/JP02/05315

§ 371 (c)(1),
(2), (4) Date: May 3, 2004

(87) PCT Pub. No.: WO02/097523

PCT Pub. Date: Dec. 5, 2002

(65) Prior Publication Data

US 2004/0196415 A1 Oct. 7, 2004

(30) Foreign Application Priority Data

May 31, 2001 (JP) ..... 2001-163996

(51) Int. Cl.
*G09G 3/36* (2006.01)

(52) U.S. Cl. ..... 345/96

(58) Field of Classification Search ..... 345/96, 345/94, 211, 212, 213
See application file for complete search history.

(56) References Cited

U.S. PATENT DOCUMENTS

| | | | | |
|---|---|---|---|---|
| 3,919,476 | A * | 11/1975 | Torpi | 358/426.01 |
| 6,396,469 | B1 * | 5/2002 | Miwa et al. | 345/87 |
| 2001/0038369 | A1 * | 11/2001 | Adachi et al. | 345/87 |

FOREIGN PATENT DOCUMENTS

| | | |
|---|---|---|
| JP | 7-84254 | 3/1995 |
| JP | 11-109921 | 4/1999 |
| JP | P2000-193937 A | 7/2000 |
| JP | P2002-31790 A | 1/2002 |

* cited by examiner

*Primary Examiner*—Amr A. Awad
*Assistant Examiner*—Michael Pervan
(74) *Attorney, Agent, or Firm*—McDermott Will & Emery LLP

(57) ABSTRACT

A liquid crystal display element driving method or a liquid crystal display device uses a liquid crystal display element having a plurality of pixels constituting a screen; divides a frame period into a plurality of write periods and outputs gate signals to select the pixels sequentially during the write periods; forms each of source signals such that the source signal includes a picture signal and a non-picture signal respectively assigned for the write periods; writes each of the source signals corresponding to the selected pixels to each of the pixels with its polarity being alternated; and displays an image responsive to the source signals on the screen of the liquid crystal display element in such a manner that a transmittivity of liquid crystals of each of the pixels is controlled in accordance with the written source signal, wherein the non-picture signal having a polarity identical to that of the picture signal to be written subsequently is written to the pixels.

26 Claims, 13 Drawing Sheets

LIQUID CRYSTAL DISPLAY ELEMENT DRIVING METHOD AND LIQUID CRYSTAL DISPLAY USING THE SAME

TECHNICAL FIELD

The present invention relates to a method of driving a liquid crystal display element and a liquid crystal display device using the method and, particularly, to the liquid crystal display device employing a liquid crystal mode capable of achieving a high speed response and a wide angle of visibility.

BACKGROUND ART

An active matrix type liquid crystal display using a thin film transistor (TFT) is used in various fields such as a display of a camcorder and a display of a personal computer or a personal word processor owing to its advantages such as a reduced thickness, a reduced weight, and capability of low voltage driving, and there is a large market for such liquid crystal display.

In recent years, particularly, the liquid crystal display has been used for displaying dynamic images and has been applied to televisions in addition to the conventional use for displaying static images in a personal computer and the like, and there is an increasing demand for a liquid crystal display device suitable for such dynamic image display. In order to meet such demand, a liquid crystal display element of a bend orientation is proposed in Japanese Unexamined Patent Publication No. 7- 84254 as the liquid crystal element which enables improvements in high speed response required for the dynamic image display. In the liquid crystal element of bend orientation, liquid crystals rapidly change with a change of voltage, thereby realizing the high speed response. It is possible to achieve such bend orientation by transitioning an initial orientation which is called splay orientation through an application of a voltage; however, the bend orientation undesirably returns to the splay orientation when the voltage applied to the liquid crystals is below a predetermined value. In view of the above problem, the present applicant has filed a Japanese patent application (Japanese Patent Application No. 2000- 214827 which has not been published yet) which proposes a driving method of a liquid crystal display element, wherein a signal voltage different from a picture signal voltage is applied to liquid crystals in order to prevent the reverse transition from the bend orientation to the splay orientation.

Also, Japanese Unexamined Patent Publication No. 11 - 109921 proposes a driving method of a liquid crystal display element, wherein a blanking image is displayed using a non-image signal which is inserted between picture signals so as to reduce a blurring of dynamic image which is peculiar to the liquid crystals.

This conventional liquid crystal display element driving method will be explained with reference to the accompanying drawings. Shown in FIG. 12 is a timing chart indicating contents of gate signals and a source signal in the conventional liquid crystal display element driving method, wherein FIG. 12A is a graph showing the gate signals and FIG. 12B is a graph showing the source signal.

In FIGS. 12A and 12B, a gate ON voltage Vgon is applied to gate lines sequentially using gate signals Sgl to Sgend, thereby bringing switching elements provided for respective pixels to an ON state. Then, a source signal Ssn is supplied from each of source lines to each of the pixels in accordance with the switching ON timing, and a potential difference between a pixel electrode and a counter electrode reaches a value responsive to a voltage applied by the source signal Ssn. Hereinafter, a state in which a potential difference between a pixel electrode and a counter electrode in a certain pixel becomes a predetermined voltage by the source signal Ssn is expressed as the source signal is written to the pixel. In this case, the gate ON voltage Vgon is applied twice to each of the gate lines during each of frame periods Po and Pe; a picture signal 101 from the source line is written as the source signal Ssn to each of the pixels in the first Vgon application, and a non-picture signal 102 from the source line is written as the source signal Ssn to each of the pixels in the second Vgon application. Owing to the writing of non-picture signal 102, the reverse transition of liquid crystals to the splay orientation is prevented in each of the pixel.

By the way, in general liquid crystal display devices, a liquid crystal display element is AC driven for the purpose of suppressing burn-in of liquid crystals and generation of display unevenness due to ions. Accordingly, the non-picture signal 102 is written to the pixels when applying the second gate ON voltage Vgon during the odd frame period Po, and then the picture signal 101 having a reverse polarity is written to the pixels when applying the first gate ON voltage Vgon during the succeeding even frame period Pe. Therefore, the writing of the picture signal 101 causes a great potential difference, and the potential of the pixel electrode does not reach the potential responsive to the picture signal 101 to lead to generation of the display unevenness.

Further, along with future developments in high resolution liquid crystal panels, time allowed for writing one source signal will become shorter and shorter, and, therefore, it will be necessary to write a signal with reliability in such shortened period of time.

DISCLOSURE OF THE INVENTION

The present invention has been accomplished in view of the above problems, and a first object thereof is to provide a liquid crystal display element driving method and a liquid crystal display device using the method which enable a picture signal to be rapidly written to a pixel in the case where a plurality of times of signal writings are performed for each of the pixels during each of frame periods as in a liquid crystal display of a bend orientation.

A second object of the invention is to provide a liquid crystal display element driving method and a liquid crystal display device using the method which enable a picture signal to be written to a pixel with reliability in the case of high resolution display.

In order to attain the above objects, a liquid crystal display element driving method or a liquid crystal display device using the method according to the invention uses a liquid crystal display element having a plurality of pixels constituting a screen and comprises a gate driving step or gate driving means of dividing a frame period into a plurality of write periods and outputting gate signals to select the pixels sequentially during the write periods and a source driving step or source driving means of forming each of source signals such that the source signal includes a picture signal and a non-picture signal assigned for the write periods and writing each of the source signals corresponding to the selected pixels to each of the pixels with its polarity being alternated, thereby controlling a transmittivity of liquid crystals of each of the pixels in accordance with the written source signal to display an image responsive to the source signals on the screen of the liquid crystal display element, wherein the source driving step or the source driving means enables to write the non-picture signal to the pixel with its polarity being identical to that of the picture signal to be written subsequently.

With such constitution, a potential difference in the case of writing the picture signal subsequently to the non-picture signal is reduced, thereby enabling the picture signal to be rapidly written to the pixel.

In this case, the non-picture signal may be written to the pixel at least during a last one of the plurality of write periods in the source driving step or by the source driving means.

Alternatively, the non-picture signal may be written to the pixel at least during a first one of the plurality of write periods in the source driving step or by the source driving means.

Further, the picture signal and the non-picture signal may have the same polarity during the frame period.

With such constitution, an amplitude between the picture signal and the non-picture signal is reduced during the frame period, thereby reducing time required for a potential of the source signal to reach a desired signal potential of each of the pixels and suppressing influences of resistance in the source line and signal delay due to parasitic capacitance. Therefore, it is possible to write the picture signal to the pixel more rapidly. Further, it is possible to reduce a load on the source driving means for supplying the source signal.

Also, the pixels may be selected during a plurality of periods in at least one of the plurality of write periods in the gate driving step or by the gate driving means, and the non-picture signal may be written to the selected pixels during the plurality of periods in the gate driving step or by the gate driving means.

With such constitution, time allowed for writing the picture signal to each of the pixels is substantially increased, thereby enabling the picture signal to be written to each of the pixels with reliability.

In this case, the plurality of periods may be consecutive.

With such constitution, rising and falling periods of the picture signal are reduced, so that the substantial signal writing time is further increased. Therefore, the picture signal is written to each of the pixels with higher reliability.

A liquid crystal display element driving method and the liquid crystal display device using the method according to the invention uses a liquid crystal display element having a plurality of pixels constituting a screen and comprises a gate driving step or gate driving means for dividing a frame period into four or more write periods and outputting gate signals to select the pixels sequentially during the write periods and a source driving step or source driving means for forming each of source signals such that the source signal includes picture signals corresponding to three colors of red, green, and blue assigned respectively for three write periods of the four or more write periods and writing each of the source signals corresponding to the selected pixels to each of the pixels with its polarity being alternated, thereby controlling a transmittivity of liquid crystals of each of the pixels in accordance with the written source signal to display a color image responsive to the source signals on the screen of the liquid crystal display element.

With such constitution, by writing a signal having a predetermined voltage in a write period other than the write periods in which the picture signals corresponding to the three colors of red, green, and blue are written, it is possible to prevent a reverse transition to a splay orientation in the liquid crystal display element or the liquid crystal display device capable of color display.

In this case, in the source driving step or by the source driving means, each of the source signals may be formed such that the source signal includes at least one non-picture signal assigned for the write period other than the write periods in which the picture signals corresponding to the three colors of red, green, and blue are written.

With such constitution, it is possible to prevent the reverse transition to splay orientation more effectively.

In this case, in the source driving step or by the source driving means, the non-picture signal may be written to the pixels during at least a last one of the four or more write periods.

Alternatively, in the source driving step or the source driving means, the non-picture signal may be written to the pixels during at least a first one of the four or more write periods.

Also, in the source driving step or by the source driving means, the picture signals may be written to the pixels with their polarities being alternated.

With such constitution, the liquid crystals are AC driven with a higher frequency thereby to further suppress display unevenness.

A liquid crystal display element driving method and the liquid crystal display device using the method according to the invention uses a liquid crystal display element having a plurality of pixels constituting a screen and comprises a gate driving step or gate driving means for dividing a frame period into three write periods and outputting gate signals to select the pixels sequentially during the write periods and a source driving step or source driving means for forming each of source signals such that the source signal includes picture signals corresponding to three colors of red, green, and blue assigned respectively for the three write periods and writing each of the source signals corresponding to the selected pixels to each of the pixels with its polarity being alternated, thereby controlling a transmittivity of liquid crystals of each of the pixels in accordance with the written source signal to display a color image responsive to the source signals on the screen of the liquid crystal display element, wherein the source driving step or the source driving means enables at least two consecutive ones of the picture signals to be written to the pixels with their polarities being identical to each other.

With such constitution, the liquid crystals are AC driven with a higher frequency, thereby suppressing burn-in or display unevenness and flickering.

In this case, the picture signals may be reversed in polarity every frame period.

With such constitution, a higher frequency driving is achieved, so that further suppressing of the display unevenness is achieved.

Also, in the above case, the pixels may be formed in matrix to be selected row by row or column by column sequentially in the gate driving step or by the gate driving means, and the source signals corresponding to the respective pixels selected row by row or column by column may be written sequentially row by row or column by column to the selected pixels in the source driving step or by the source driving means.

With such constitution, the liquid crystal element is driven with a simple constitution.

The above and other objects, characteristics, and advantages will become apparent from the following detailed description of preferred embodiments given with reference to the accompanying drawings.

BRIEF DESCRIPTION OF THE DRAWINGS

FIGS. 2A and 2B constitute a timing chart showing contents of gate signals and a source signal in the liquid crystal display device of FIG. 1, wherein FIG. 2A is a graph showing the gate signals and FIG. 2B is a graph showing the source signal.

FIG. 3A and FIG. 3B are graphs showing changes in potential of a pixel electrode in the liquid crystal display device of FIG. 1, wherein FIG. 3A is the graph showing the changes in black display, and FIG. 3B is the graph showing the changes in white display.

FIGS. 4A and 4B are graphs showing changes in potential of a pixel electrode, wherein FIG. 4A is the graph showing the changes in the case of switching from black display to white display in the liquid crystal display device of FIG. 1, and FIG. 4B is the graph showing the changes in the case of switching from black display to white display in a conventional example.

FIGS. 6A and 6B constitute a timing chart showing contents of gate signals and a source signal in a liquid crystal display device according to a second embodiment of the invention, wherein FIG. 6A is a graph showing the gate signals and FIG. 6B is a graph showing the source signal.

FIGS. 7A and 7B constitute a timing chart showing contents of gate signals and a source signal in a liquid crystal display device according to a third embodiment of the invention, wherein FIG. 7A is a graph showing the gate signals and FIG. 7B is a graph showing the source signal.

FIGS. 8A and 8B constitute a timing chart showing contents of gate signals and a source signal in a liquid crystal display device according to a fourth embodiment of the invention, wherein FIG. 8A is a graph showing the gate signals and FIG. 8B is a graph showing the source signal.

FIGS. 9A and 9B constitute a timing chart showing contents of gate signals and a source signal in a liquid crystal display device according to a fifth embodiment of the invention, wherein FIG. 9A is a graph showing the gate signals and FIG. 9B is a graph showing the source signal.

FIGS. 10A and 10B constitute a timing chart showing contents of gate signals and a source signal in a liquid crystal display device according to a sixth embodiment of the invention, wherein FIG. 10A is a graph showing the gate signals and FIG. 10B is a graph showing the source signal.

FIGS. 11A and 11B constitute a timing chart showing contents of gate signals and a source signal in a liquid crystal display device according to a seventh embodiment of the invention, wherein FIG. 11A is a graph showing the gate signals and FIG. 11B is a graph showing the source signal.

FIGS. 12A and 12B constitute a timing chart showing contents of gate signals and a source signal in a conventional driving method of a liquid crystal display element, wherein FIG. 12A is a graph showing the gate signals and FIG. 12B is a graph showing the source signal.

BEST MODE FOR CARRYING OUT THE INVENTION

Hereinafter, the embodiments of the present invention will be described with reference to the drawings.

First Embodiment

Figure 1:
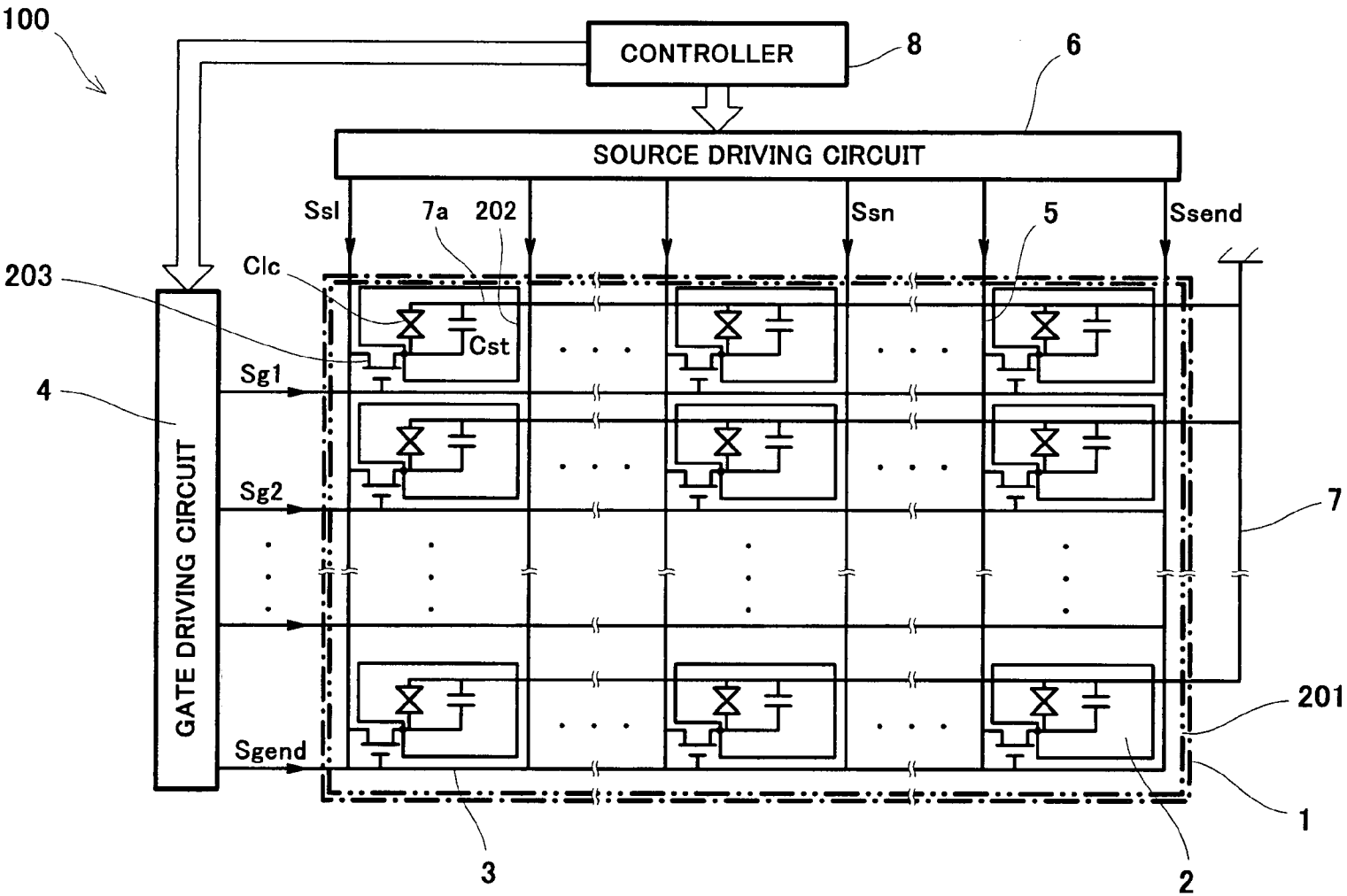
FIG. 1 is a block diagram showing an overall structure of a control system of a liquid crystal display device according to a first embodiment of the present invention.

FIG. 1 is a block diagram showing an overall structure of a control system of a liquid crystal display device according to the first embodiment of the present invention.

As shown in FIG. 1, a liquid crystal display device 100 includes a liquid crystal display element 1, a gate driving circuit 4, and a source driving circuit 6, and a controller 8.

The liquid crystal element 1 is a known one, and it is of the active matrix type in this embodiment. The liquid crystal display element 1 has a TFT substrate (not shown), a counter substrate (not shown) opposed to the TFT substrate, and liquid crystals disposed therebetween. Inside the TFT substrate, a plurality of pixel electrodes 202 are formed in the shape of rows and columns (hereinafter referred to as matrix), and gate lines 3 and source lines 5 are disposed for the respective rows and columns of the pixel electrodes 202 in matrix. A region occupied by each of the pixel electrodes 202 as viewed from a direction of a thickness of the liquid crystal display element (more precisely, of a liquid crystal cell) is a pixel 2, and a region occupied by the overall pixels 2 is a screen. Each of the pixel electrodes 202 is connected to a relevant one of the source lines 5 via a switching element 203 and a relevant one of the gate lines 3 is connected to a gate of the switching element 203. The switching element 203 is formed by TFT, for example. Each of the pixels 2 has a common electrode 7*a*, and all the common electrodes 7*a* are electrically connected to one another and grounded by a common wiring 7. In turn, an inner face of the counter substrate, a counter electrode 201 is formed. Liquid crystal capacitance is denoted by Clc. Storage capacitance is denoted by Cst.

The controller 8 supplies a picture signal, which is input externally, to the source driving circuit 6 and outputs a control signal to each of the source driving circuit 6 and the gate driving circuit 4, whereby the source driving circuit 6 and the gate driving circuit 4 are so controlled as to generate and output source signals Ssl to Ssend and gate signals Sgl to Sgend, respectively. The gate driving circuit 4 sends the gate signals Sgl to Sgend to the switching elements 203 of the pixels 2 respectively via the gate lines 3 to bring the switching elements to ON state sequentially. The source driving circuit 6 sends the source signals Ssl to Ssend to the pixel electrodes 202 respectively via the source lines 5. In this case, the source signals Ssl to Ssend are sent in accordance with timings of the ON operations of the switching elements 203 of the pixels 2. Thus, electric fields respectively corresponding to the source signals Ssl to Ssend are generated between the pixel electrodes 202 and the counter electrode 201, and transmittivities of the liquid crystals changes depending on the thus-generated electric fields. Accordingly, luminance of light emitted from a backlight (not shown) is modulated depending on the changes in transmittivity, and an image responsive to the source signals Ssl to Ssend is displayed on the screen of the liquid crystal element 1.

Figures 2A, 2B:
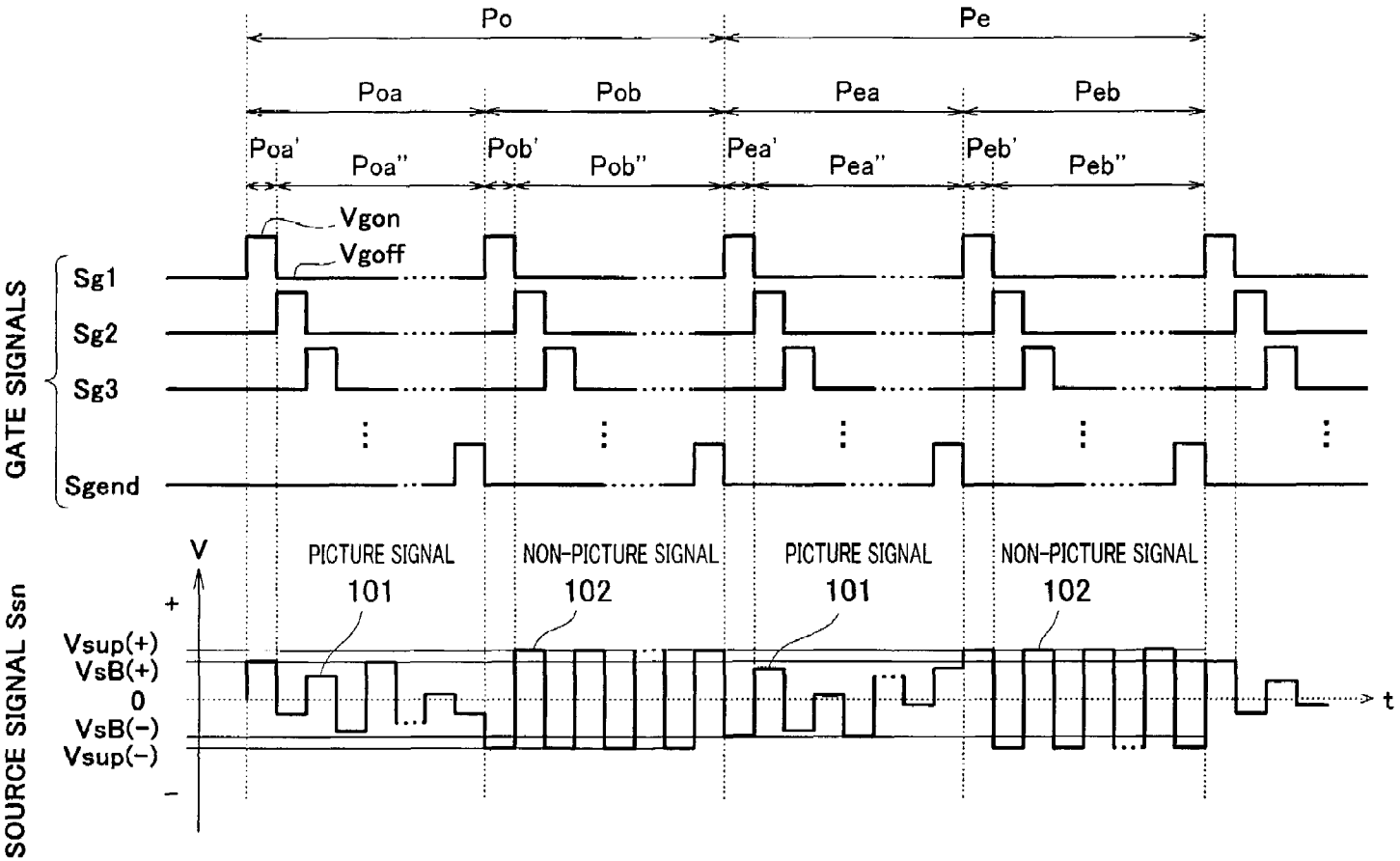

Next, constitution of the gate driving circuit 4 and the source driving circuit 6 will be described in detail. FIGS. 2A and 2B constitute a timing chart showing contents of gate signals and a source signal in the liquid crystal display device of FIG. 1, wherein FIG. 2A is a graph showing the gate signals and FIG. 2B is a graph showing the source signal.

Referring to FIGS. 1, 2A, and 2B, the source driving circuit 6 is so constituted as to generate and output the source signals Ssl to Ssend which are characteristic of this embodiment as shown in FIG. 2B. Though a source signal Ssn which is selected arbitrarily among the source signals Ssl to Ssend output for the respective gate lines 5 is shown in FIG. 2B, the other source signals are similar to the source signal Ssn. The source signal Ssn is sectioned as to correspond to each frame. An odd frame period is denoted by Po, and an even frame period is denoted by Pe. Each of the frame periods Po and Pe is bisectioned into two write periods which are a first write period Poa for writing a picture signal to all the pixels 2 in one column and a second write period Pob for writing a non-picture signal in the same manner. Accordingly, the source signal Ssn is constituted of the picture signal 101 for the first write period Poa and the non-picture signal 102 for the second write period Pob. Further, the first write period Poa and the second write period Pob are divided into periods Poa' (hereinafter referred to as pixel write periods) for writing the picture signal to each of the pixels 2 in one column and pixel write periods Pob' for writing the non-picture signal to each of the pixels in one column, respectively. The source signal Ssn has voltage values corresponding to predetermined display gradations for the respective pixel write periods Poa' and Pob'. In the source signal Ssn, a polarity is alternated in order to AC drive the liquid crystal element 1. The polarity is reversed every pixel write period (Poa', Pob'), and every frame period (Po, Pe). Also polarities of the first write period Poa during which the picture signal 101 is written and the second write period Pob during which the non-picture signal 102 is written are reversed from each other. Therefore, a polarity of a non-picture signal write period (Pob in the drawing) in a certain frame period is identical to that of a picture signal write period (Pea in the drawing) in a succeeding frame period. As used herein, VsB(+) and VsB(−) are voltage values for black display, and Vsup(+) and Vsup(−) are voltage values for non-picture signals.

The gate driving circuit 4 is so constituted as to generate and output the gate signals Sgl to Sgend which are similar to those of the conventional example. Each of the gate signals Sgl to Sgend is a binary signal which has a voltage Vgon at a high level (hereinafter referred to as H level) and a voltage of Vgoff at a low level (hereinafter referred to as L level), and becomes the H level during the pixel write periods Poa', Pob', Pea', and Peb' of the relevant pixels 2 while becomes the L level during remaining retention periods Poa", Pob", Pea", and Peb". Therefore, each of the gate signals Sgl to Sgend becomes the H level twice in each of the frame periods Po and Pe; once in each of the first write periods Poa and Pea and once in each of the second write periods Pob and Peb. Thus, when the gate signals Sgl to Sgend are output, switching elements 203 of the pixels 2 are turned on row by row sequentially during the respective pixel write periods Poa', Pob', Pea', and Peb'. During each of the ON periods, the picture signal 101 and the non-picture signal 102 of each of the source signals Ssl to Ssend corresponding to each of the pixels 2 are written.

Figure 3B:
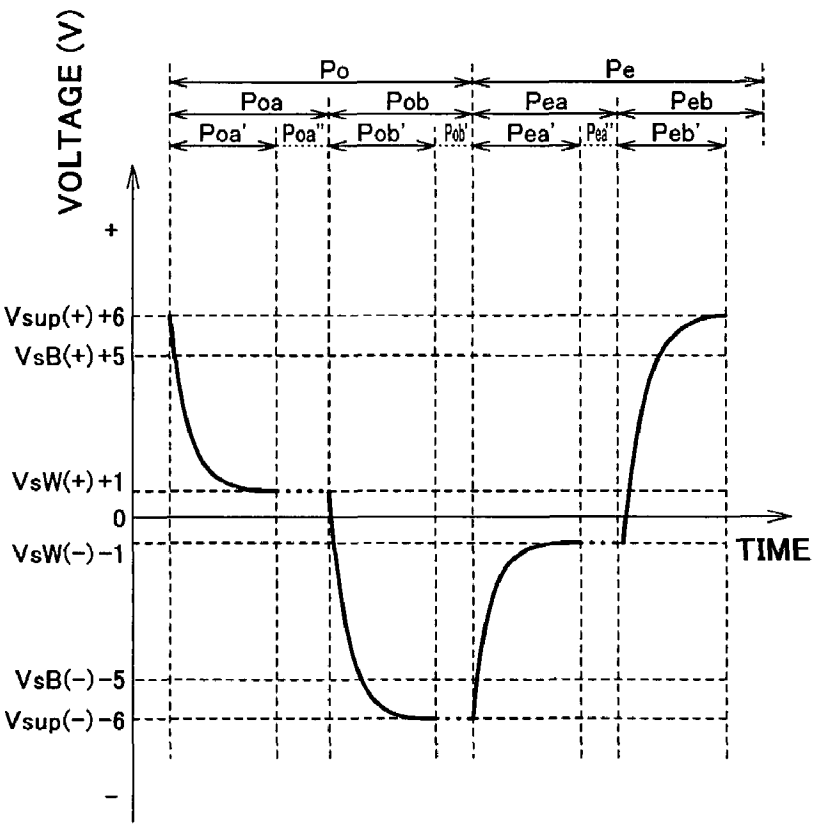
Figure 3A:
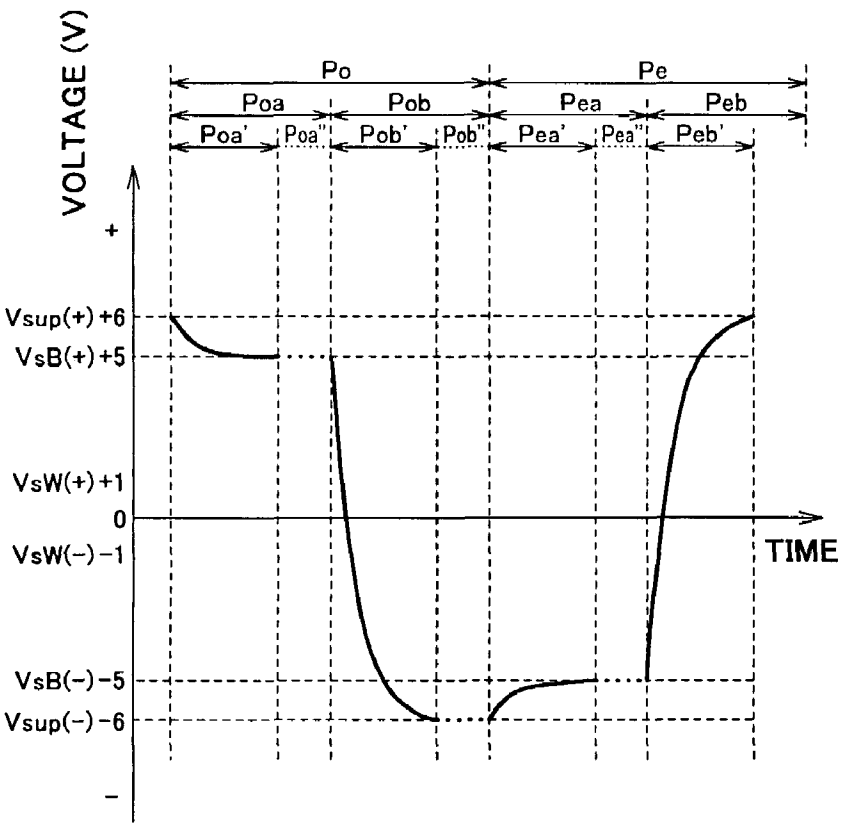
Figure 4B:
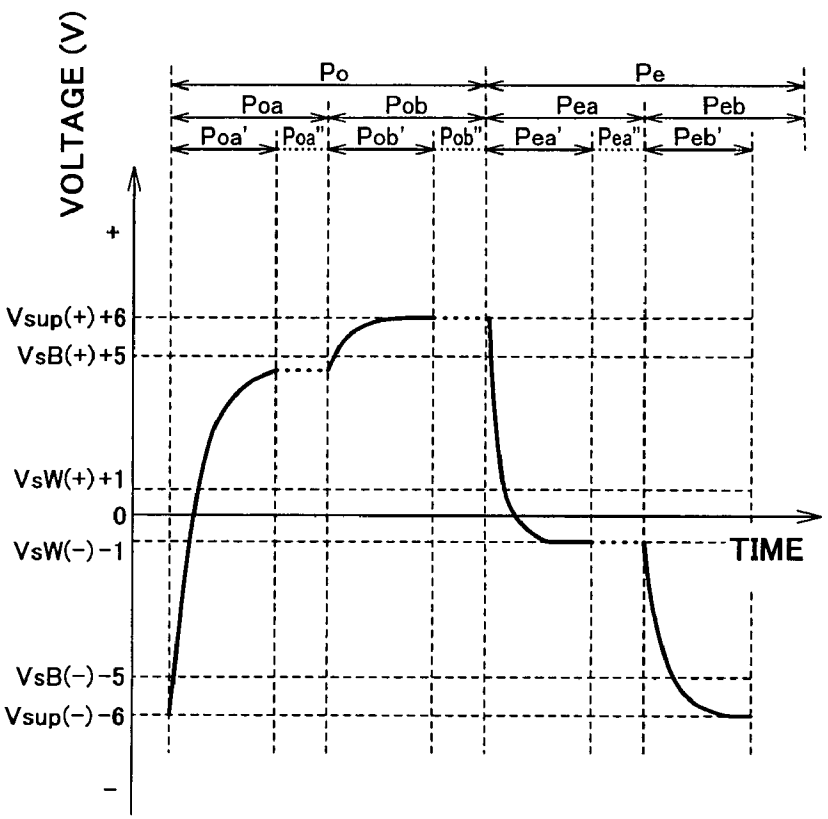
Figure 4A:
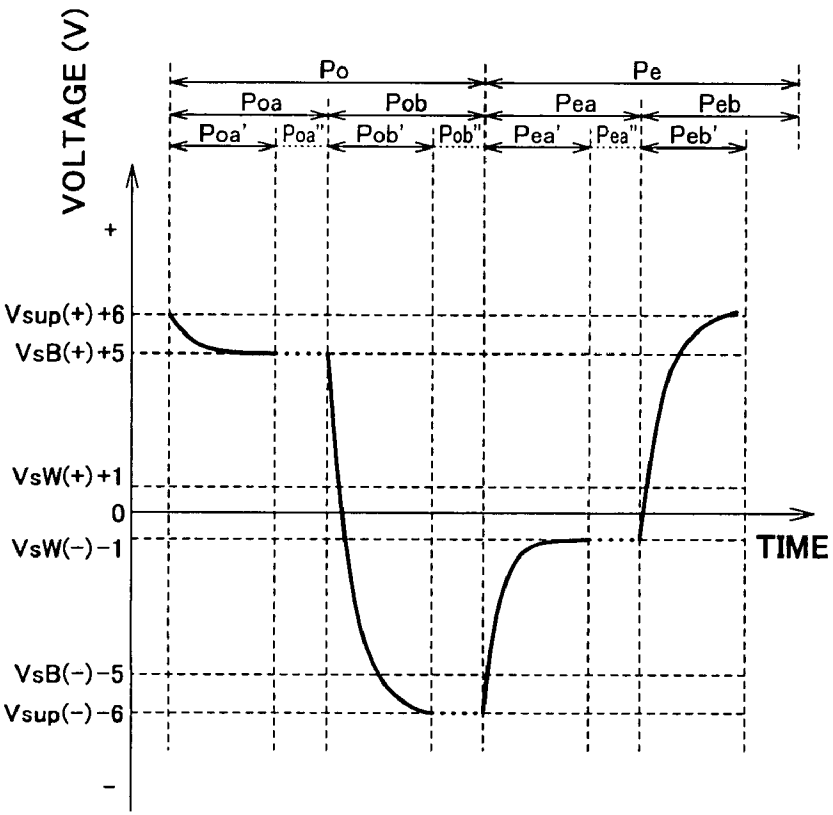
Figure 5:
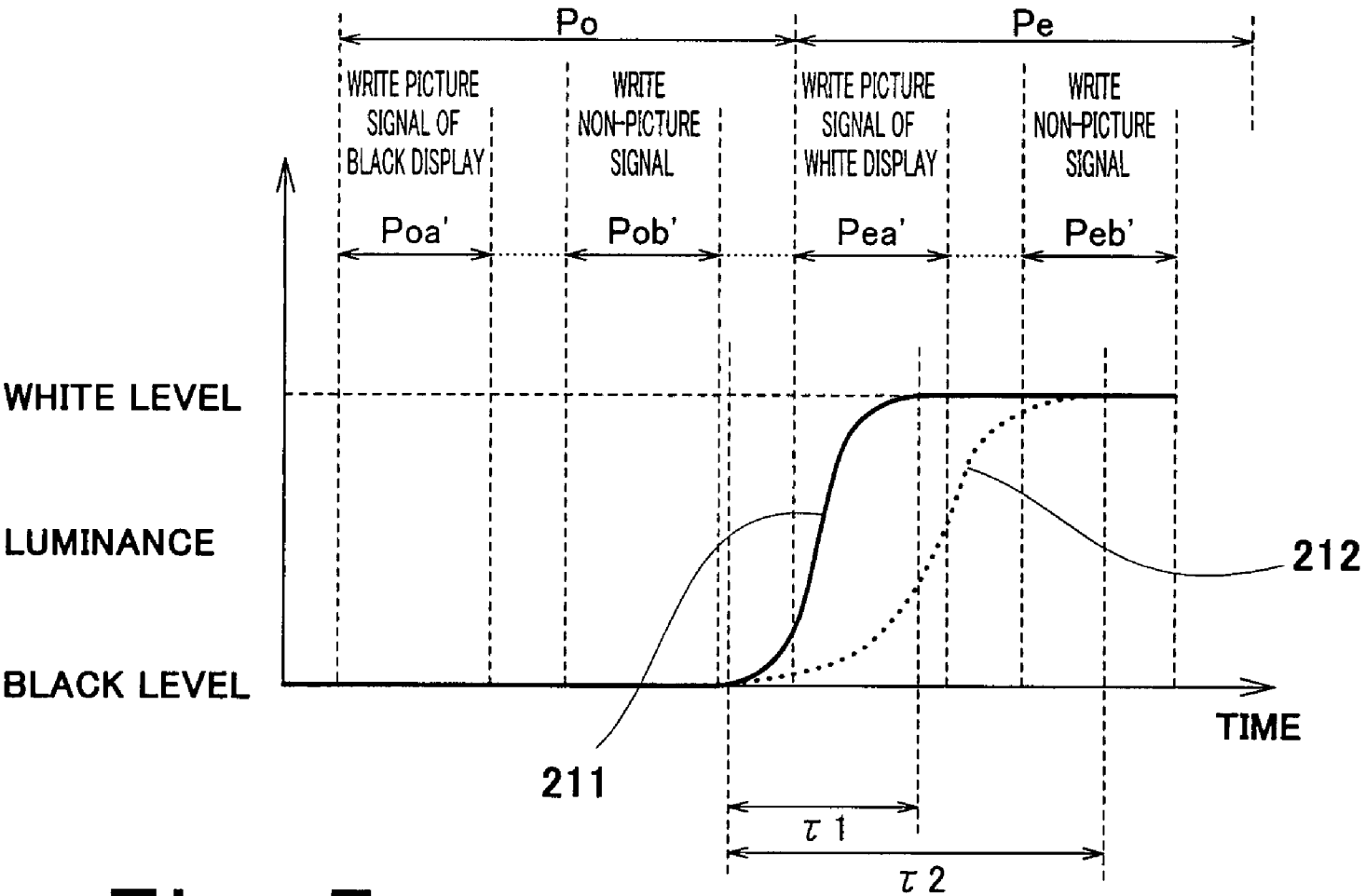
FIG. 5 is a graph showing changes in luminance of liquid crystals of a certain pixel in the case of switching from black display to white display.

Next, operation of the thus-constituted liquid crystal display device (a driving method of the liquid crystal display element) will be described with reference to FIGS. 1 to 5B. FIG. 3A and FIG. 3B are graphs showing changes in potential of a certain pixel electrode in the liquid crystal display device of FIG. 1, wherein FIG. 3A is the graph showing the changes in black display, and FIG. 3B is the graph showing the changes in white display. FIGS. 4A and 4B are graphs showing changes in potential of a pixel electrode, wherein FIG. 4A is the graph showing the changes in the case of switching from black display to white display in the liquid crystal display device of FIG. 1, and FIG. 4B is the graph showing the changes in the case of switching from black display to white display in the conventional example. FIG. 5 is a graph showing changes in luminance of liquid crystals of a certain pixel in the case of switching from black display to white display.

In this embodiment, the normally white mode is employed. The voltage Vgon at the H level of the gate signal Ssn is set at 15 V, and the voltage Vgoff at the L level of the signal Ssn is set at −10 V. An amplitude of the source signal Ssn is set with respect to the potential of the counter electrode 201 in such a manner that: the voltages Vsup(+) and Vsup(−) for the non-picture signal are +6 V and −6 V, respectively; VsB(+) and VsB(−) for the black display level are +5 V and −5 V, respectively; and VsW(+) and VsW(−) for the white display level are +1 V and −1 V, respectively, and a duration of each of the frame periods is 16.6 ms (60 Hz). Further, a response in an arbitrary pixel 2 in the fist row among the pixels in matrix is described by way of example.

Referring to FIGS. 1 to 5B, a case of black display of a certain pixel 2 of the liquid crystal element 1 will be described. In this case, as shown in FIG. 3A, the picture signal 101 of the black display level of the source signal is input during the pixel write period Poa' of the first write period Poa of an odd frame Po. Then, in accordance with a discharge characteristic which depends on the capacitance of the pixel 2, the potential of the pixel electrode 202 is changed from +6 V which is the voltage value Vsup(+) of the non-picture signal 102 of the preceding frame period to +5 V which is the black display level VsB(+). The value is retained during the retention period Poa". After that, the non-picture signal 102 is input during the pixel write period Pob' of the second write period Pob. In this case, since the non-picture signal 102 has a polarity opposite to that of the picture signal 101, the potential of the pixel electrode 202 is changed from +5 V to −6 V which is the voltage value Vsup(−) of the non-picture signal. The value is retained during the retention period Pob". Then, the picture signal 101 of the white level of the source signal Ssn is input during the pixel write period Pea' of the first write period Poa of the succeeding odd frame Pe. In this case, since the picture signal has the same polarity with the non-picture signal 102 of the preceding frame, the potential of the pixel electrode 202 is changed from −6 V to −5 V which is the white display level VsW in accordance with a charge characteristic which depends on the capacity of the pixel 2. The value is retained during the retention period Pea". Then, the non-picture signal 102 is input during the pixel write period Peb' of the second write period Peb. In this case, the non-picture signal 102 has a polarity opposite to that of the picture signal 101, the potential of the pixel electrode 202 is changed from −5 V to +6 V which is the voltage value Vsup(+) of the non-picture signal 102. The value is retained during the retention period Peb" (not shown).

As described above, according to this embodiment, at the time when the non-picture signal 102 is written to the pixel 2 and, after that, the picture signal 101 in the succeeding frame period is written to the pixel 2, the polarities of the non-picture signal 102 and the picture signal 101 are identical to each other. Therefore, it is possible to reduce the potential difference to be written, and, in this example, the potential difference is reduced to about 1 V. Consequently, it is possible to perform the writing of the picture signal 101 with a liberal allowance of time.

Figure 13:
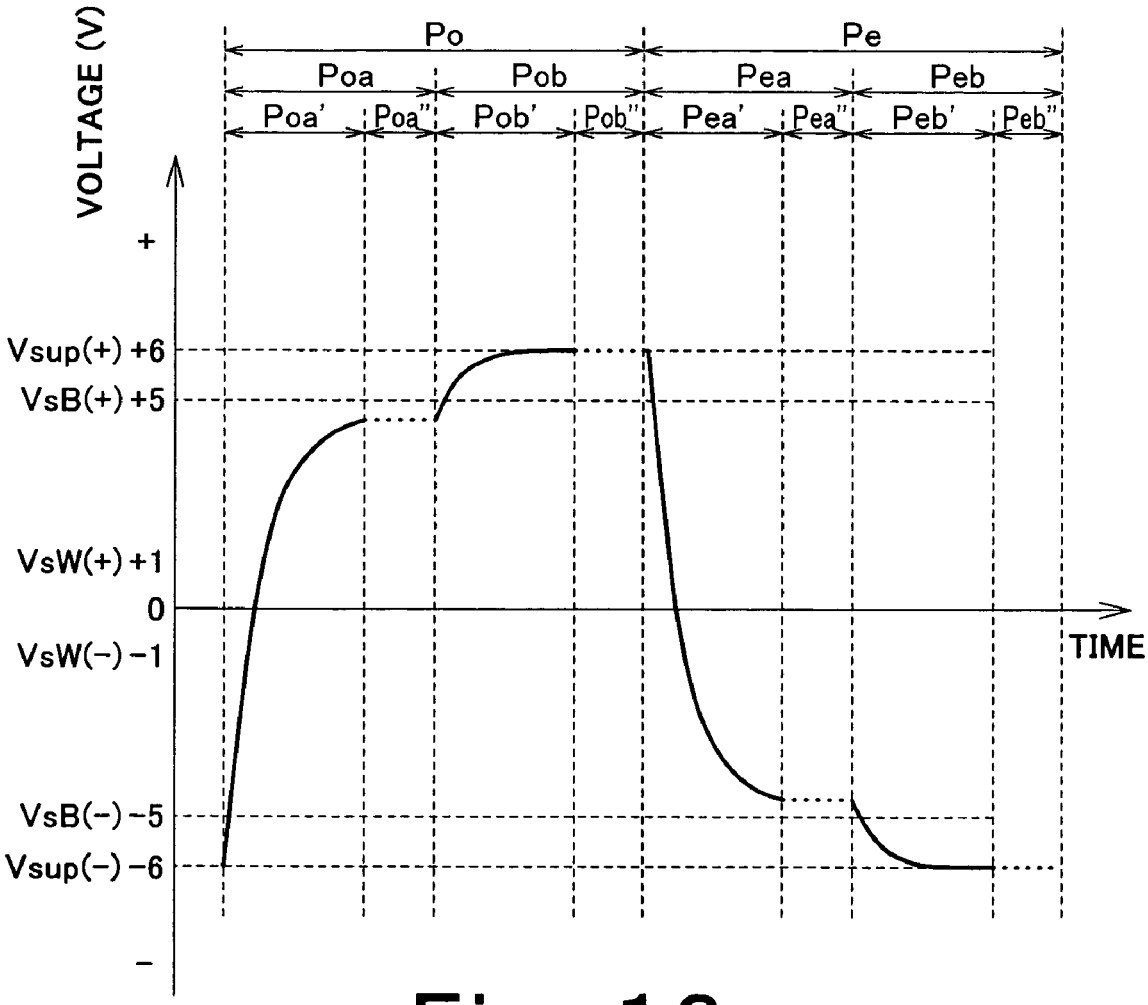
FIG. 13 is a graph showing changes in potential of a pixel electrode in the case of performing black display in a conventional liquid crystal display element.

The above operation will hereinafter be compared with the conventional example shown in FIG. 13. In the conventional example, waveforms and potentials of gate signals Sgl to Sgend and a source signal Ssn are the same as those of the present embodiment. As a result, when performing the black display, a potential difference of writing the picture signal 101 during a frame period after writing the non-picture signal 102 is about 11 V in each of the odd frame period Po and the even frame period Pe, and it is impossible to write a sufficient potential required for performing the black display to the pixel electrode 202, resulting in display unevenness of the liquid crystal display device.

In addition, it is necessary to perform the signal writing with respect to the potential difference of about 11 V when writing the non-picture signal 102 after writing the picture signal 101 also in this embodiment; however, the writing is performed without any trouble as shown in FIG. 3A. Further, since the non-picture signal 102 is essentially used for the purpose of preventing the reverse transition, it is not problematic at all from the practical standpoint if the potential of the pixel electrode 202 was not transitioned perfectly to the predetermined potential in the write period so far as the potential is close to the predetermined potential. In view of this, the black display performed in accordance with this embodiment is failsafe.

Next, the white display of the pixel 2 of the liquid crystal element 1 will be described. In this case, as shown in FIG. 3B, the picture signal 101 is input during the pixel write period Poa' of the first write period Poa of the even frame Po. Then, a potential of the pixel electrode 202 changes from +6 V which is the voltage value Vsup(+) of the non-picture signal 102 in the preceding frame period to +1 V which is the white display level VsW(+). The value is retained during the retention period Poa". Then, the non-picture signal 102 is input during the pixel write period Pob' of the second write period Pob. The potential of the pixel electrode 202 then changes from +1 V to −6 V which is the voltage value Vsup(−) of the non-picture signal 102. The value is retained during the retention period Pob". Then, the picture signal 101 of the white display level of the source signal Ssn is input during the pixel write period Pea of the first write period Poa of the next even frame Pe. Then, the potential of the pixel electrode changes from −6 V to −1 V which is the white display level VsW(−). The value is retained during the retention period Pea". Next, the non-picture signal 102 is input during the pixel write period Peb' of the second write period Peb. Then, the potential of the pixel electrode 202 changes from −5 V to +6 V which is the voltage Vsup(+) of the non-picture signal 102. The value is retained during the retention period Peb" (not shown).

The above-described white display is the case of performing the white display under the worst conditions in this embodiment; however, even in this worst case, it is possible to suppress the potential difference when writing the picture signal 101 after writing the non-picture signal 102 to about 5 V, and the signal writing is performed without any trouble.

In addition, in the case of performing the white display, a response speed is slowed down since the liquid crystals transition to the white display state owing to relaxation; therefore, the liquid crystals may in some cases fail to perfectly transition to the white display state even when the potential difference is smaller than that of the black display. In this embodiment, since the potential difference in writing the picture signal is 5 V, as described above, which is smaller than that (7 V) achieved by the conventional example (see FIG. 4B), the white display is performed without any trouble.

Further, referring to FIGS. 3A and 3B, after writing the source signal Ssn to the pixel 2, a pixel voltage drop called a punch-through voltage occurs in actuality due to a coupling of the capacity of the switching element 203 and the pixel capacity at the time point when the gate signal falls to bring the switching element 203 to the OFF state; however, explanation for such pixel voltage drop is omitted in order to simplify the description.

Next, a case of switching from the black display to the white display will be described. FIGS. 4A and 4B are graphs showing changes in potential of a certain pixel electrode in the case of switching from the black display to the white display, wherein FIG. 4A is the graph showing the changes in this embodiment, and FIG. 4B is the graph showing the changes in the conventional example.

As shown in FIG. 4B, when switching from the black display to the white display in the conventional example, the non-picture signal 102 of the preceding frame period (the odd frame period Po in FIG. 4B) has a polarity opposite to that of the picture signal 101 of the white display of the succeeding frame period (the even frame period Pe in FIG. 4B) and has a larger voltage to be applied to liquid crystals. In turn, in this embodiment, when switching from the black display to the white display, the non-picture signal 102 of the preceding frame period (the odd frame period Po in FIG. 4A) has the same polarity as the picture signal 101 of the white display of the succeeding frame period (the even frame period Pe in FIG. 4A) and has a larger voltage to be applied to liquid crystals. Therefore, in this embodiment, the liquid crystals operate more rapidly as compared with the conventional example owing to the identical polarity of the non-picture signal 102 and the picture signal 101, and, as a result, a response speed of the liquid crystals is improved. This effect is shown in FIG. 5. FIG. 5 is a graph showing changes in luminance of a liquid crystal display device with respect to time in the case of switching from the black display to the white display. In FIG. 5, the reference numeral 211 denotes a luminance change curve with respect to time of the liquid crystal display device according to this embodiment, and the reference numeral 212 denotes a luminance change curve with respect to time of the conventional liquid crystal display device. Referring to FIG. 5, the response speed of the liquid crystals with respect to the switching from the black display to the white display of the liquid crystal display device according to this embodiment, i.e. the time $\tau 1$ required for the luminance to transition from a black level to a white level, is shorter than a response speed $\tau 2$ of liquid crystals of the conventional liquid crystal display device.

As described in the foregoing, in this embodiment, the liquid crystal display without unevenness on the whole screen is realized, and the effect of improving the response speed is achieved.

If the potential of the pixel electrode 202 fails to reach the desired one in writing the picture signal 101, such failure results in the display unevenness; however, it is possible to achieve the reverse transition prevention effect sufficiently as far as the voltage having the predetermined value or more is applied to the liquid crystals in writing the non-picture signal 102 even if the potential of the pixel electrode 202 dose not reach the set voltage Vsup. Further, in the case of attaining sharpness of dynamic images by inserting the black display per frame period, sufficient sharpness of dynamic images is achieved as far as the black level is displayed during writing the picture signal 101 even if the non-picture signal 102 at the time of the black insertion does not exactly reach the potential of black display. Therefore, the voltage Vsup may be set to a value identical to the black display potential.

Further, though the non-picture signal is written after writing the picture signal in each of the frame periods in this embodiment, the non-picture signal may be written before writing the picture signal. In this case, the similar effect is achieved by setting the polarities of the picture signal and the non-picture signal identical to each other in the frame period. Also, though the retention period after writing the picture signal and the retention period after writing the non-picture signal are identical in duration in this embodiment, the durations are not critical and may be different from each other. In that case, the display brightness, the reverse transition prevention effect, the sharpness of dynamic images, and the like are changed, but, in both of the cases, the signal writing ability is improved, and the display unevenness is suppressed.

Second Embodiment

Figures 6A, 6B:
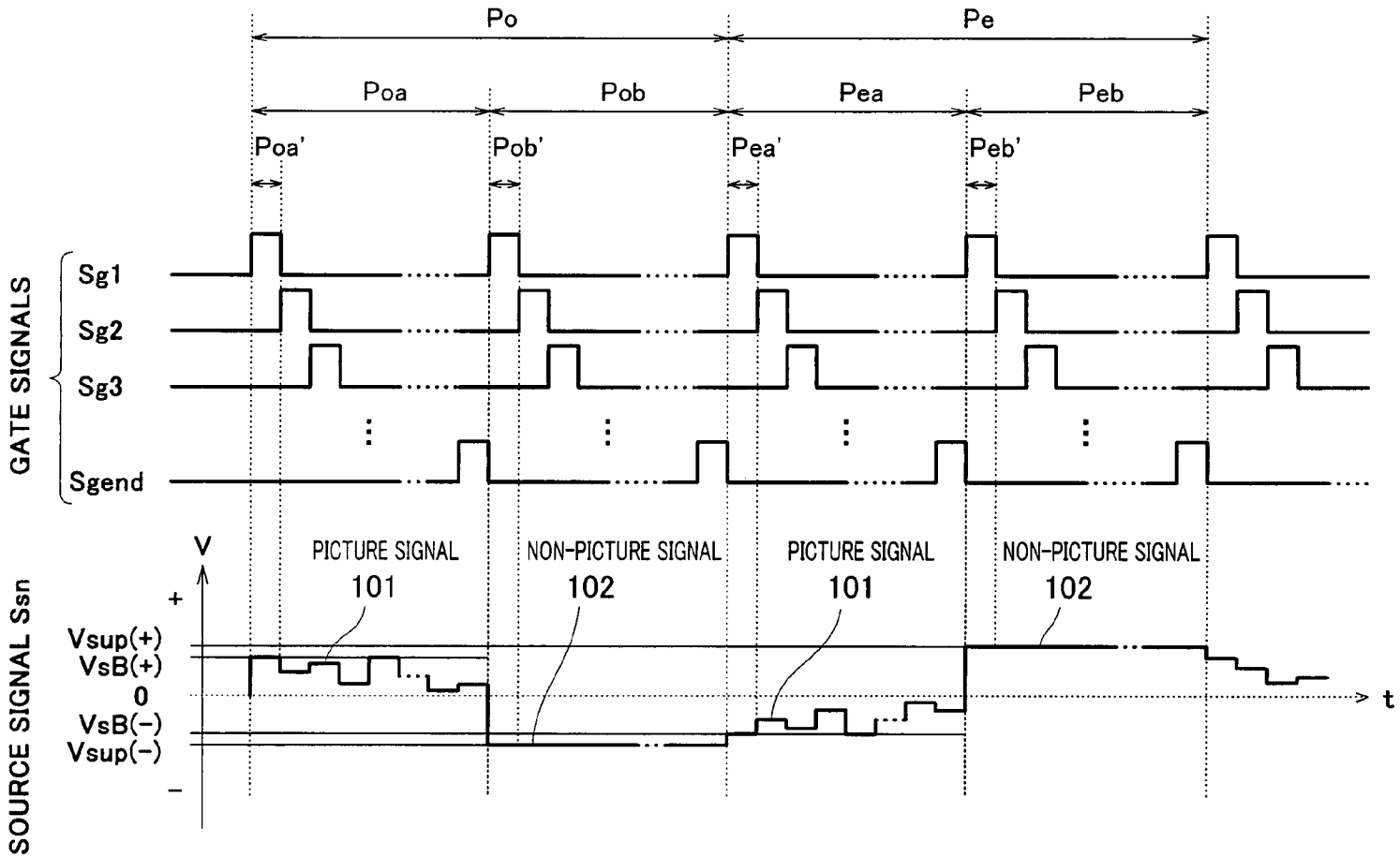

FIGS. 6A and 6B constitute a timing chart showing contents of gate signals and a source signal in a liquid crystal display device according to the second embodiment of the invention, wherein FIG. 6A is a graph showing the gate signals and FIG. 6B is a graph showing the source signal. In FIGS. 6A and 6B, the reference numerals identical to those of FIGS. 2A and 2B denote components identical or equivalent to those of FIGS. 2A and 2B.

As shown in FIGS. 6A and 6B, unlike the first embodiment, a polarity of the picture signal 101 of the source signal Ssn remains unchanged during each of frame periods Po and Pe and a polarity of a non-picture signal 102 remains unchanged during each of the frame periods Po and Pe in this embodiment. Other parts of constitution are the same as the first embodiment.

With such constitution, an amplitude of the source signal Ssn during the write periods Poa and Pea of the picture signal 101 and the write periods Pob and Peb of the non-picture signal 102 is reduced. Therefore, it is possible to reduce time required for a potential of the source signal to reach a desired signal potential of each of pixels and to suppress influence of signal delay due to resistance in source lines 5 and parasitic capacitance. Thus, signal writing ability is further improved. Further, a load on the driving circuit 6 for supplying the source signal Ssn is reduced.

Third Embodiment

Figure 7A:
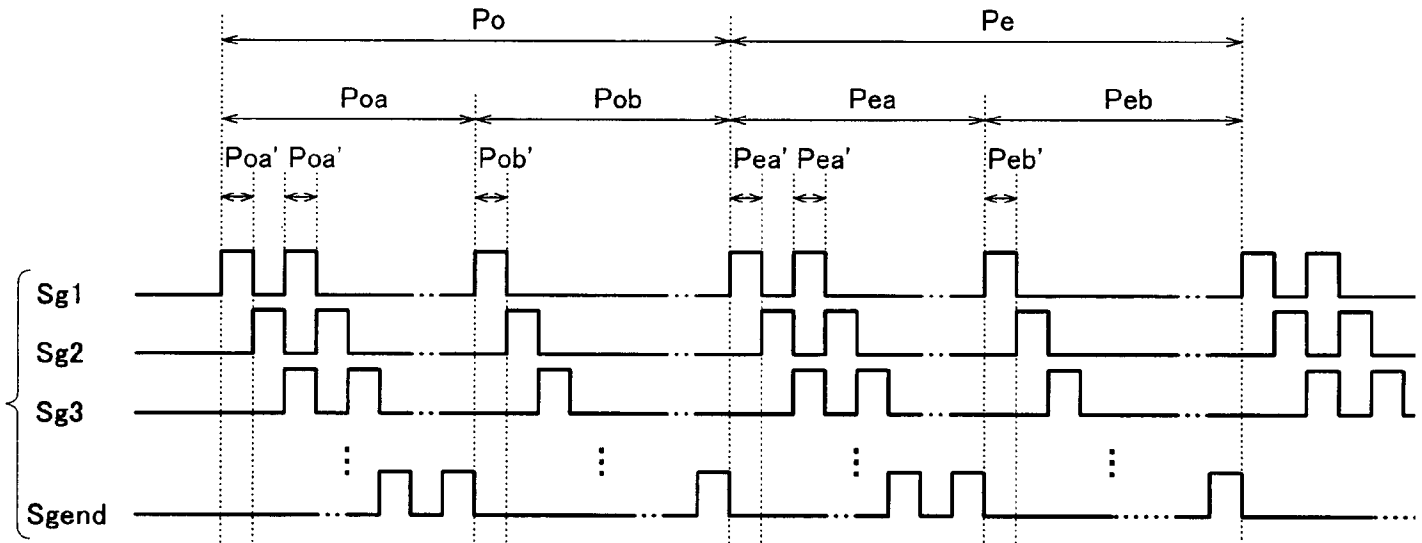
Figure 7B:
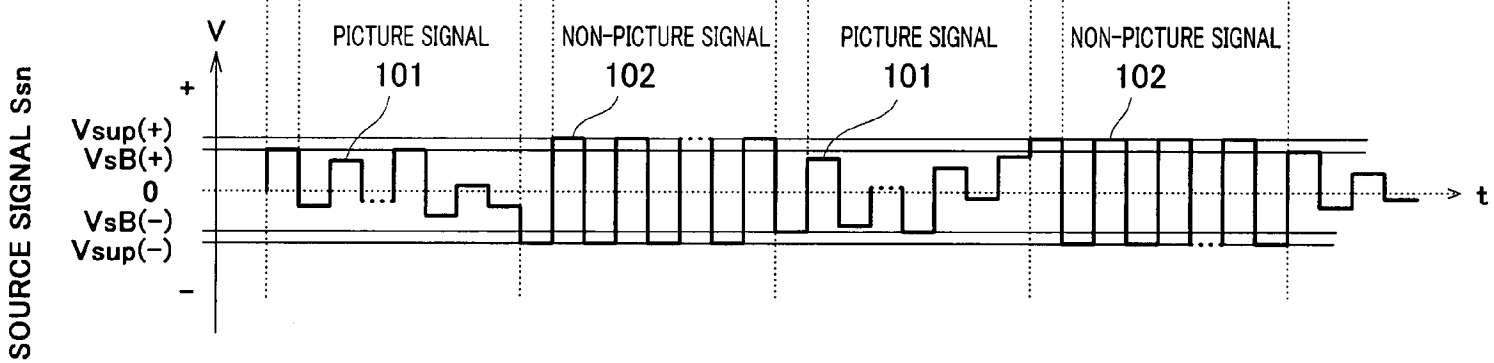

FIGS. 7A and 7B constitute a timing chart showing contents of gate signals and a source signal in a liquid crystal display device according to a third embodiment of the invention, wherein FIG. 7A is a graph showing the gate signals and FIG. 7B is a graph showing the source signal. In FIGS. 7A and 7B, the reference numerals identical to those of FIGS. 2A and 2B denote components identical or equivalent to those of FIGS. 2A and 2B.

As shown in FIGS. 7A and 7B, unlike the first embodiment, each of the pixel write periods Poa' and Pea' of the picture signal 101 is provided twice in each of the frame periods Po and Pe in this embodiment. In this case, the picture signal 101 to be written to the pixel is actually written in each of the latter pixel write periods. Other parts of constitution are the same as the first embodiment.

With such constitution, the write period for the picture signal 101 is effectively increased, thereby further improving the ability of writing the picture signal 101.

Fourth Embodiment

Figures 8A, 8B:
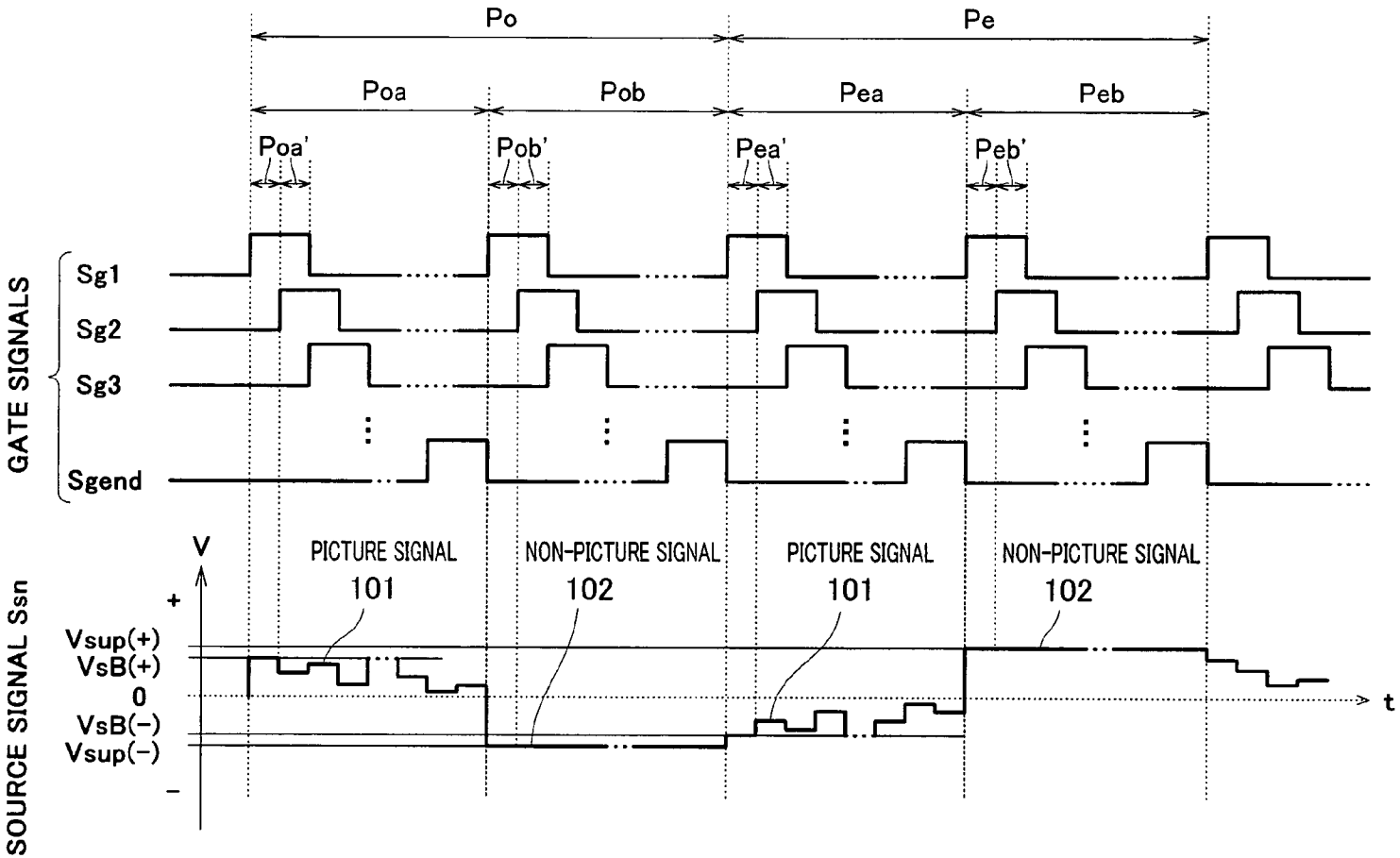

FIGS. 8A and 8B constitute a timing chart showing contents of gate signals and a source signal in a liquid crystal display device according to a fourth embodiment of the invention, wherein FIG. 8A is a graph showing the gate signals and FIG. 8B is a graph showing the source signal. In FIGS. 8A and 8B, the reference numerals identical to those of FIGS. 2A and 2B denote components identical or equivalent to those of FIGS. 2A and 2B.

As shown in FIGS. 8A and 8B, each of the pixel write periods of the picture signal 101 and the non-picture signal 102 is provided twice consecutively in each of the frame periods Po and Pe. In other words, a length of each of the pixel write periods of the picture signal and the non-picture signal is twice that of the first embodiment. In this case, the picture signal 101 to be written to the pixel is actually written in each of the latter pixel write periods Poa' and Pea'. Other parts of constitution are the same as the first embodiment.

With such constitution, falling and rising periods of the picture signal 101 are reduced as compared with the third embodiment, thereby further increasing a substantial write period for the picture signal 101. Therefore, the ability of writing the picture signal 101 is further improved as compared with the third embodiment.

Fifth Embodiment

Figures 9A, 9B:
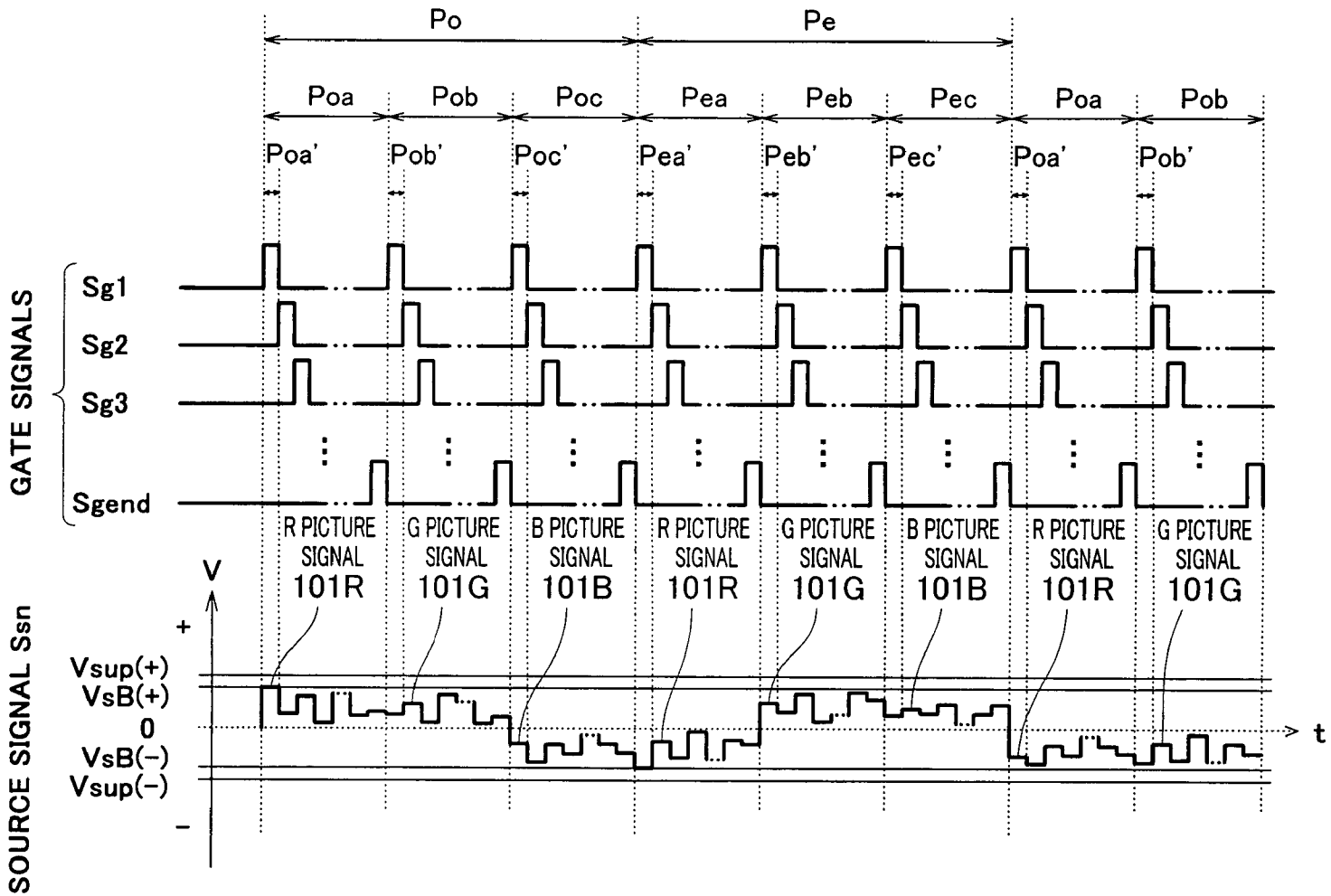

FIGS. 9A and 9B constitute a timing chart showing contents of gate signals and a source signal in a liquid crystal display device according to a fifth embodiment of the invention, wherein FIG. 9A is a graph showing the gate signals and FIG. 9B is a graph showing the source signal. In FIGS. 9A and 9B, the reference numerals identical to those of FIGS. 2A and 2B denote components identical or equivalent to those of FIGS. 2A and 2B.

The liquid crystal display device of this embodiment is capable of color display, and the overall constitution is as follows. The liquid crystal display device is different from the liquid crystal display device of the first embodiment in that a light source of backlight (not shown) has a cool cathode tube (not shown) capable of emitting light respectively for red (hereinafter abbreviated to R), green (hereinafter abbreviated to G), and blue (hereinafter abbreviated to blue); a circuit (not shown) for controlling timings of the light emission is provided; and a controller 8, a gate driving circuit 4, and a source driving circuit 6 same as those shown in FIG. 1 output a control signal, a gate signal, and a source signal, respectively, in a way of sectioning a frame period according to R, G, and B. Other parts of the constitution are the same as the liquid crystal display device of the first embodiment. Since the overall constitution is known, the detailed description therefor is omitted.

Specifically, as shown in FIGS. 9A and 9B, the liquid crystal display device of this embodiment divides each of the frame periods Po and Pe into a first, a second, and a third write periods (Poa, Pea), (Pob, Peb), and (Poc, Pec) in the field sequential driving, and a picture signal for R (hereinafter referred to as R picture signal) 101R, a picture signal for G (hereinafter referred to as G picture signal) 101G, and a picture signal for B (hereinafter referred to as B picture signal) 101B are written respectively in the first, the second, and the third write periods (Poa, Pea), (Pob, Peb), and (Poc, Pec). A pixel write period for the R picture signal 101R, a pixel write period for the G picture signal 101G, and a pixel write period for the B picture signal 101B in the odd frame period Po are denoted by Poa', Pob', and Poc'. A pixel write period for the R picture signal 101R, a pixel write period for the G picture signal 101G, and a pixel write period for the B picture signal 101B in the even frame period Pe are denoted by Pea', Peb', and Pec'. A polarity of each of the picture signals 101R, 101G, and 101B is unchanged during each of the picture signal write periods Poa, Pob, Poc, Pea, Peb, and Pec, and the polarity is reversed every two consecutive picture signal write periods.

With such constitution, the polarity is reversed only once during each of the frame periods Po and Pe in writing the picture signals 101R, 101G, and 101B to the pixel, thereby reducing a potential difference to be written in the case where the polarity is not reversed. Thus, the writings of the picture signals 101R, 101G, and 101B are facilitated. Also, since an amplitude of the source signal is reduced, deterioration in writing ability otherwise caused by a delay in the source signal Ssn is suppressed. Further, since the polarity of the source signal Ssn changes at least once in each of the frame periods Po and Pe, an effect of reducing flickering and burn-in in displaying a picture is achieved. In view of the above results, this embodiment enables color display without unevenness in a whole image on the screen.

Sixth Embodiment

Figures 10A, 10B:
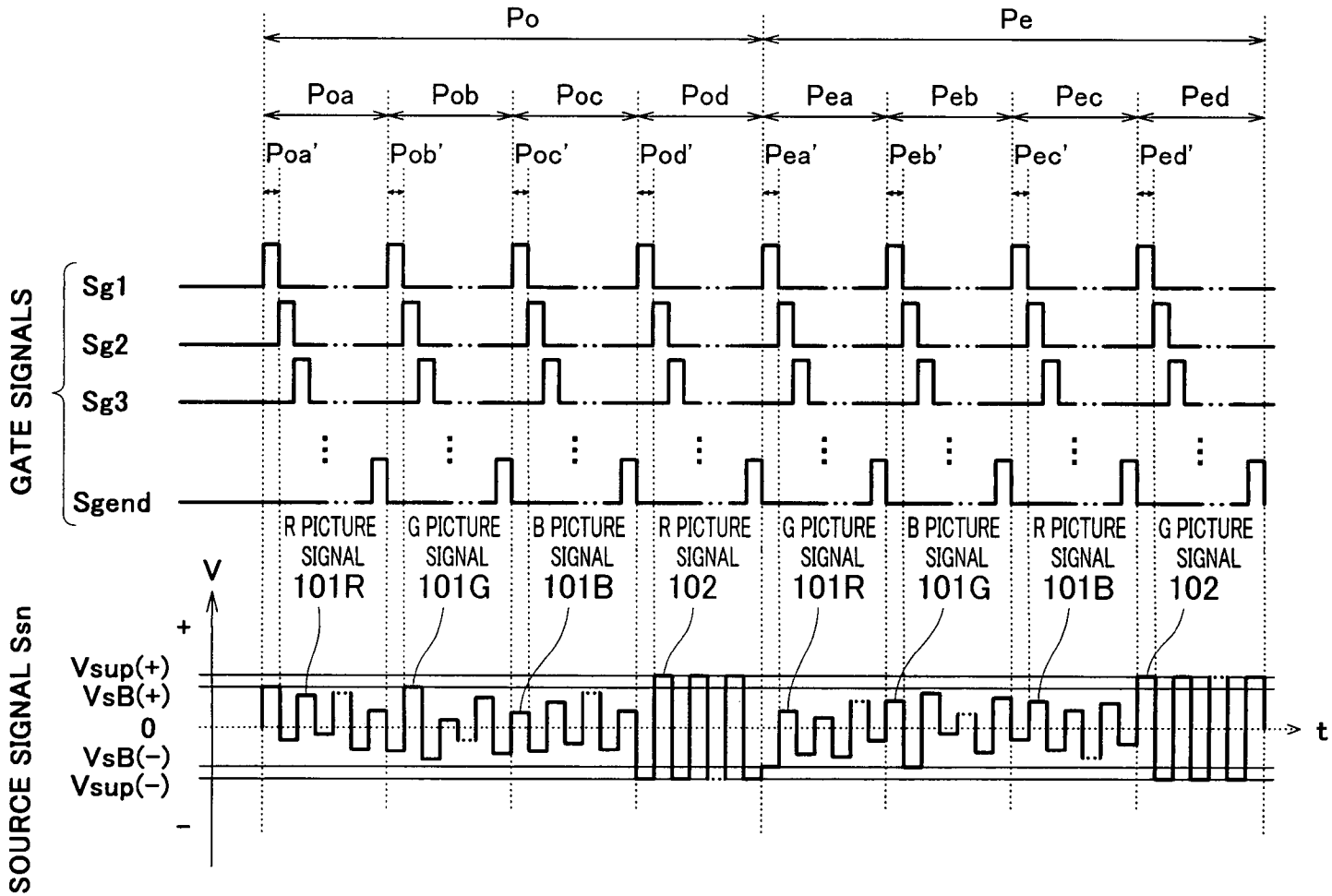

FIGS. 10A and 10B constitute a timing chart showing contents of gate signals and a source signal in a liquid crystal display device according to a sixth embodiment of the invention, wherein FIG. 10A is a graph showing the gate signals and FIG. 10B is a graph showing the source signal. In FIGS. 10A and 10B, the reference numerals identical to those of FIGS. 9A and 9B denote components identical or equivalent to those of FIGS. 9A and 9B.

Unlike the fifth embodiment, the liquid crystal display device of this embodiment has the following constitution. That is, each of the frame periods Po and Pe is divided into four write periods of first to fourth write periods (Poa, Pea), (Pob, Peb), (Poc, Pec), and (Pod, Ped), and an R picture signal 101R, a G picture signal 101G, a B picture signal 101B, and a non-picture signal 102 are written in the first to fourth write periods (Poa, Pea), (Pob, Peb), (Poc, Pec), and (Pod, Ped), respectively. A polarity of each of the picture signals 101R, 101G, and 101B, and the non-picture signal 102 is reversed every pixel write period Poa', Pob', Poc', Pod', Pea', Peb', Pec', and Ped' and every picture signal write period Poa, Pob, Poc, Pea, Peb, Pec. Further, the Polarity of the non-picture signal 102 of the preceding frame period is identical to that of the initial picture signal 101R in the succeeding frame period. Other parts of the constitution are the same as the fifth embodiment.

With such construction, in the case of using the liquid crystal mode performing the bend transition, it is possible to prevent the reverse transition to the splay orientation in the field sequential driving because the non-picture signal 102 is also written, and color display without unevenness in a whole image on the screen is realized because the polarity of the non-picture signal 102 of the preceding frame period is the same as that of the picture signal 101 of the succeeding frame period.

Seventh Embodiment

Figures 11A, 11B:
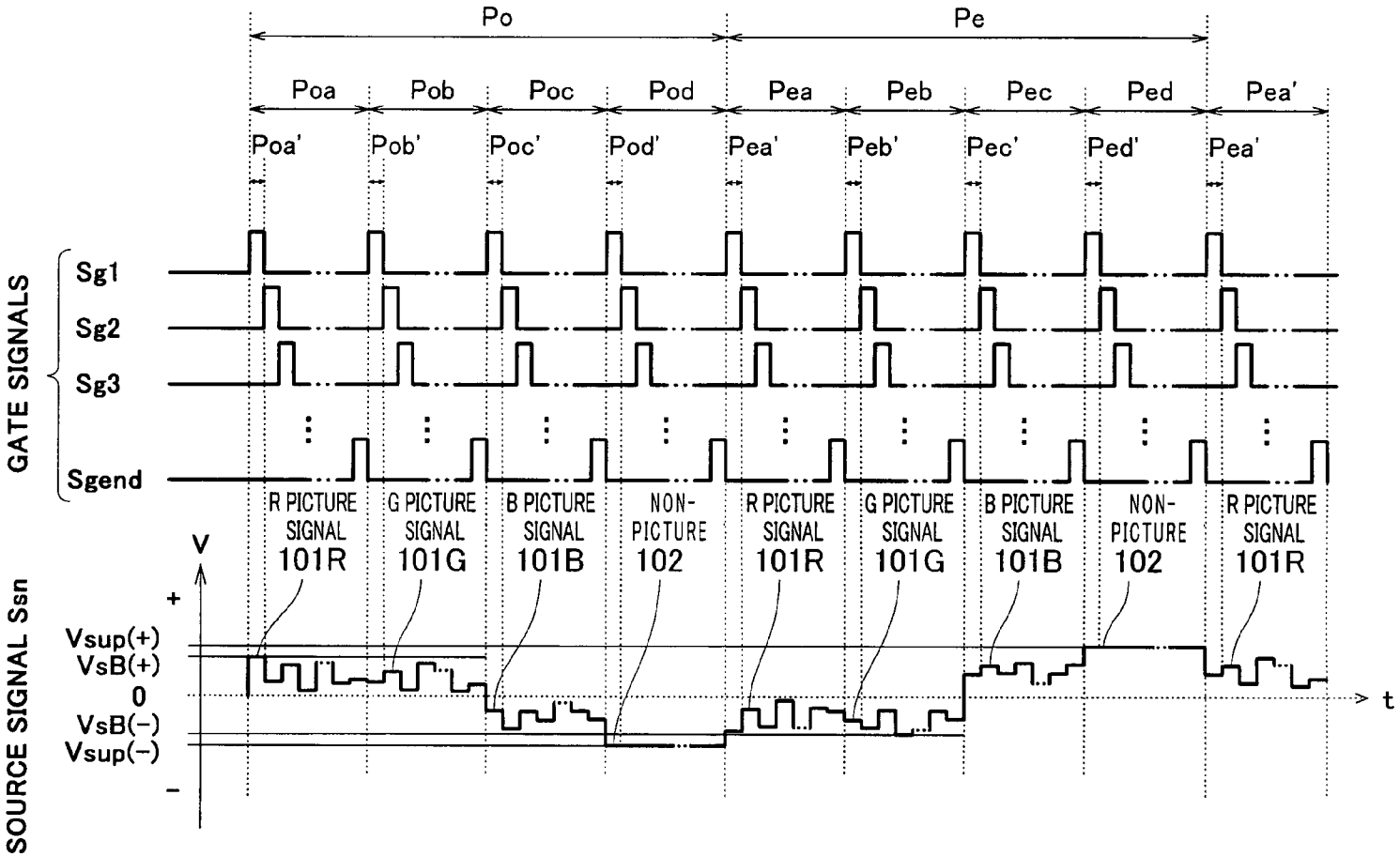
Figure 12A:
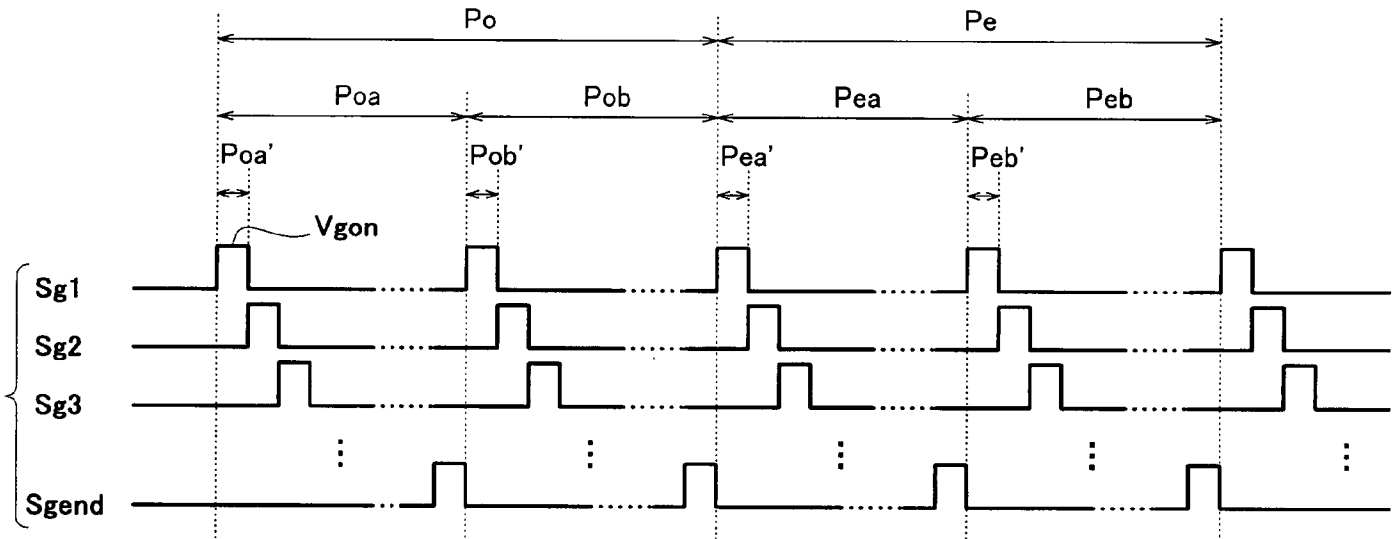
Figure 12B:
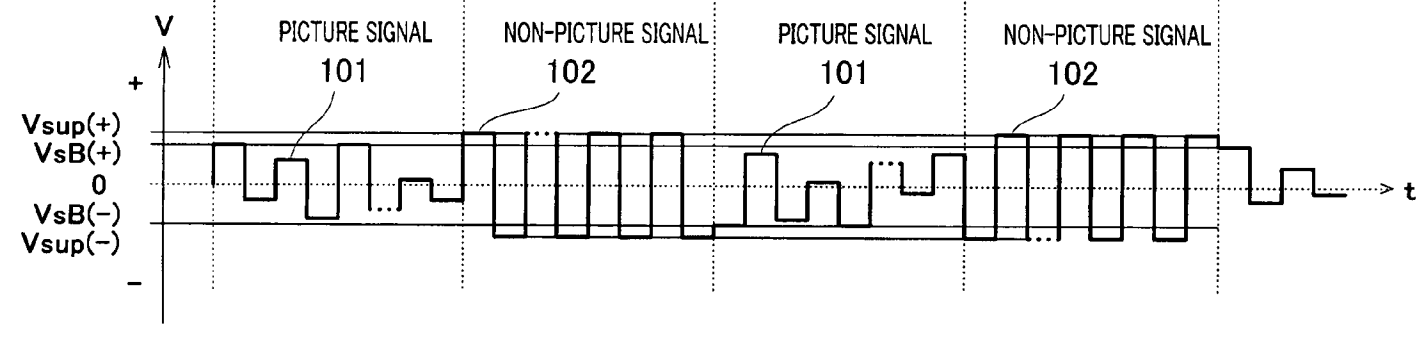

FIGS. 11A and 11B constitute a timing chart showing contents of gate signals and a source signal in a liquid crystal display device according to a seventh embodiment of the invention, wherein FIG. 11A is a graph showing the gate signals and FIG. 11B is a graph showing the source signal. In FIGS. 11A and 11B, the reference numerals identical to those of FIGS. 10A and 10B denote components identical or equivalent to those of FIGS. 10A and 10B.

In this embodiment, unlike the sixth embodiment, a polarity of each of the picture signals 101R, 101G, 101B and the non-picture signal 102 is unchanged during each of picture signal write periods Poa, Pob, Poc, Pea, Peb, and Pec, and the polarity is reversed every four write periods including three picture signal write periods and one non-picture write period during consecutive two frame periods Po and Pe. As a result, the polarity of the non-picture signal 102 of the preceding frame period is the same as that of the initial picture signal 101R of the succeeding frame period. Other parts of the constitution are the same as the sixth embodiment.

With such constitution, too, it is possible to prevent the reverse transition to the splay orientation in the field sequential driving, and color display without unevenness in a whole image on the screen is realized as in the sixth embodiment.

From the foregoing description, many modification and other embodiments will be apparent to those skilled in the art. Therefore, it should be understood that the above description is given by way of example and for the purpose of teaching the best mode for carrying out the invention to those skilled in the art. Details of the constitution and/or the function of the invention can be substantially changed without departing from the sprit of the invention.

INDUSTRIAL APPLICABILITY

The liquid crystal display device of the present invention is useful as household and industrial thin image display devices.

The driving method of liquid crystal display element of the invention is useful as household and industrial thin image display devices.

The invention claimed is:

1. A liquid crystal display device comprising: a liquid crystal display element having a plurality of pixels constituting a screen; a gate driving means for dividing a frame period into a plurality of write periods and outputting gate signals to select the pixels sequentially during the write periods; and a source driving means for forming each of source signals such that the source signal includes a picture signal and a non-picture signal respectively assigned for the write periods and writing each of the source signals corresponding to each of the selected pixels to each of the pixels with the polarity of the picture signal and non-picture signal being alternated, the liquid crystal display device displaying an image responsive to the source signals on the screen of the liquid crystal display element in such a manner that a transmittivity of liquid crystal of each of the pixels is controlled in accordance with the written source signal, wherein the source driving means writes the non-picture signal and the picture signal to each of the pixels in such a manner that the non-picture signal to be written to a pixel and the picture signal to be written subsequently to the pixel have an identical polarity.

2. The liquid crystal display device according to claim 1, wherein the source driving means writes the non- picture signal to the pixels during at least a last one of the write periods.

3. The liquid crystal display device according to claim 1, wherein the source driving means writes the non-picture signal to the pixels during at least a first one of the write periods.

4. The liquid crystal display device according to claim 1, wherein the polarity of each of the picture signal and the non-picture signal is unchanged during the frame period.

5. The liquid crystal display device according to claim 1, wherein the gate driving means selects the pixels during a plurality of periods in at least one of the plurality of write periods, and the source driving means writes the picture signal to the selected pixels during the plurality of periods.

6. The liquid crystal display device according to claim 5, wherein the plurality of periods are consecutive.

7. The liquid crystal display device according to claim 1, wherein the number of the write periods in one frame is four or more; and picture signals respectively corresponding to three colors of red, green, and blue and a non-picture signal are respectively assigned for the four or more write periods, thereby displaying a color image on the screen of the liquid crystal display element.

8. The liquid crystal display device according to claim 7, wherein the source driving means writes the non-picture signal to the pixels during at least a last one of the four or more write periods.

9. The liquid crystal display device according to claim 7, wherein the source driving means writes the non-picture signal to the pixels during at least a first one of the four or more write periods.

10. The liquid crystal display device according to claim 7, wherein the source driving means writes the picture signals to the pixels with polarities thereof being alternated.

11. A liquid crystal display device comprising: a liquid crystal display element having a plurality of pixels constituting a screen; a gate driving means for dividing a frame period into three write periods and outputting gate signals to select the pixels sequentially during the write periods; and a source driving means for forming each of source signals such that the source signal includes picture signals respectively corresponding to three colors of red, green, and blue respectively assigned for the three write periods and writing each of the source signals corresponding to each of the selected pixels to each of the pixels with its polarity being alternated, the liquid crystal display device displaying a color image responsive to the source signals on the screen of the liquid crystal display element in such a manner that a transmittivity of liquid crystals of each of the pixels is controlled in accordance with the written source signal, wherein the source driving means writes at least two consecutive ones of the picture signals to each of the pixels in such a manner that the two consecutive picture signals are written to a pixel with their polarities being identical to each other.

12. The liquid crystal display device according to claim 11, wherein polarities of the picture signals are reversed every frame period.

13. The liquid crystal display device according to any one of claim 1 or 11, wherein the pixels are formed in matrix; the gate driving means sequentially selects the pixels row by row or column by column; and the source driving means writes the source signals respectively corresponding to the pixels selected row by row or column by column to the selected pixels sequentially row by row or column by column.

14. A liquid crystal element driving method using a liquid crystal display element having a plurality of pixels constituting a screen and comprising a gate driving step of dividing a frame period into a plurality of write periods and outputting gate signals to select the pixels sequentially during the write periods and a source driving step of forming each of source signals such that the source signal includes a picture signal and a non-picture signal respectively assigned for the write periods and writing each of the source signals corresponding to each of the selected pixels to each of the selected pixels with the polarity of the picture signal and non-picture signal being alternated, thereby displaying an image responsive to the source signals on the screen of the liquid crystal element by controlling a transmittivity of liquid crystals of each of the pixels in accordance with the written source signal, wherein the source driving step is of writing the non-picture signal and the picture signal to each of the pixels in such a manner that the non-picture signal to be written to a pixel and the picture signal to be written subsequently to the pixel have an identical polarity.

15. The liquid crystal display element driving method according to claim 14, wherein the non-picture signal is written to the pixels during at least a last one of the write periods in the source driving step.

16. The liquid crystal display element driving method according to claim 14, wherein the non-picture signal is written to the pixels during at least a first one of the write periods in the source driving step.

17. The liquid crystal display element driving method according to claim 14, wherein the polarity of the picture signal remains unchanged during the frame period.

18. The liquid crystal display element driving method according to any one of claims 14 to 17, wherein the pixels are selected during a plurality of periods in at least one of the write periods in the gate driving step; and the picture signal is written to the selected pixels during the plurality of periods in the source driving step.

19. The liquid crystal display element driving method according to claim 18, wherein the plurality of periods are consecutive.

20. The liquid crystal display element driving method according to claim 14, wherein the number of the write periods in one frame is four or more; and picture signals respectively corresponding to three colors of red, green, and blue and a non-picture signal are respectively assigned for the four or more write periods, thereby displaying a color image on the screen of the liquid crystal display element.

21. The liquid crystal display element driving method according to claim 20, wherein the non-picture signal is written to the pixels during at least a last one of the four or more write periods in the source driving step.

22. The liquid crystal display element driving method according to claim 20, wherein the non-picture signal is written to the pixels during at least a first one of the four or more write periods in the source driving step.

23. The liquid crystal display element driving method according to claim 20, wherein the picture signals are written to the pixels with polarities thereof being alternated in the source driving step.

24. A liquid crystal display element driving method using a liquid crystal display element having a plurality of pixels constituting a screen and comprising a gate driving step of dividing a frame period into three write periods and outputting gate signals to select the pixels sequentially during the write periods; and a source driving step of forming each of source signals such that the source signal includes picture signals corresponding to three colors of red, green, and blue respectively assigned for the three write periods and writing each of the source signals corresponding to each of the selected pixels to each of the pixels with its polarity being alternated, thereby displaying a color image responsive to the source signals on the screen of the liquid crystal display element by controlling a transmittivity of liquid crystals of each of the pixels in accordance with the written source signal, wherein the source driving step is of writing the two consecutive ones of the picture signals to each of the pixels in such a manner that the two consecutive picture signals are written to a pixel with their polarities being identical to each other.

25. The liquid crystal display element driving method according to claim 24, wherein the polarities of the picture signals are alternated every frame period.

26. The liquid crystal display element driving method according to claim 14 or 24, wherein the pixels are formed in matrix; the pixels are selected row by row or column by column sequentially in the gate driving step; and the source signals respectively corresponding to the pixels selected row by row or column by column is written to the selected pixels row by row or column by column sequentially in the source driving step.

* * * * *